US009735491B2

(12) United States Patent
Zic

(10) Patent No.: US 9,735,491 B2
(45) Date of Patent: Aug. 15, 2017

(54) EASILY REMOVABLE CONTACTS FOR MICRO CONNECTORS

(71) Applicant: Richard Zic, Chicago, IL (US)

(72) Inventor: Richard Zic, Chicago, IL (US)

(73) Assignee: DYNOMAX INC., Wheeling, IL (US)

( * ) Notice: Subject to any disclaimer, the term of this patent is extended or adjusted under 35 U.S.C. 154(b) by 0 days.

(21) Appl. No.: 15/208,191

(22) Filed: Jul. 12, 2016

(65) Prior Publication Data

US 2017/0018870 A1 Jan. 19, 2017

Related U.S. Application Data

(60) Provisional application No. 62/192,911, filed on Jul. 15, 2015.

(51) Int. Cl.
*H01R 13/436* (2006.01)

(52) U.S. Cl.
CPC ..... *H01R 13/4367* (2013.01)

(58) Field of Classification Search
USPC ..... 439/695, 595, 321, 370, 468, 106
See application file for complete search history.

(56) References Cited

U.S. PATENT DOCUMENTS 3,953,102 A 4/1976 Rivetta et al.
4,631,637 A 12/1986 Romania et al.
4,762,500 A 8/1988 Dola et al.
4,955,827 A * 9/1990 Roy ..... H01R 13/424 439/595
4,988,316 A * 1/1991 Roy ..... H01R 13/4361 439/595
5,110,307 A 5/1992 Rapoza
5,114,355 A 5/1992 Kimmel et al.
5,147,220 A 9/1992 Lybrand
5,181,860 A * 1/1993 Honma ..... H01R 13/639 285/82
5,363,075 A 11/1994 Fanucchi
5,490,787 A 2/1996 Bowman et al.
5,709,557 A 1/1998 Martin et al.
5,778,121 A 7/1998 Hyzin
6,010,374 A * 1/2000 Miwa ..... H01R 13/4362 439/752
6,203,336 B1 * 3/2001 Nakamura ..... H01R 13/64 439/607.42
6,359,768 B1 3/2002 Eversley et al.
6,821,159 B2 * 11/2004 Munger, Jr. ..... H01R 13/645 439/680
7,393,228 B2 7/2008 Kabasawa et al.
7,396,255 B2 * 7/2008 Morello ..... H01R 13/4223 439/595

(Continued)

FOREIGN PATENT DOCUMENTS

JP 2008205545 A 9/2008
KR 2020090006789 U 7/2009

*Primary Examiner* — Alexander Gilman
(74) *Attorney, Agent, or Firm* — Vedder Price P.C.

(57) ABSTRACT

A plug including a base having a top surface, a plurality of openings in the top surface, a retraction unit having a first portion in the base and a second portion extending from the base to a position in front of a corresponding opening, and a conductive unit having a notch where the conductive unit extends through one opening such that the retraction unit engages the notch to prevent the conductive unit from passing back through the opening.

8 Claims, 2 Drawing Sheets

(56) References Cited

U.S. PATENT DOCUMENTS

| | | | | |
|---|---|---|---|---|
| 7,510,407 | B1 | 3/2009 | Blasko et al. | |
| 7,641,516 | B1 | 1/2010 | Scott et al. | |
| 7,682,205 | B2 * | 3/2010 | Hall | H01R 13/4361 439/752 |
| 7,841,886 | B2 * | 11/2010 | Klein | H01R 13/506 439/352 |
| 8,092,246 | B1 | 1/2012 | Santiago | |
| 8,257,111 | B1 * | 9/2012 | Smutny | H01R 13/5208 439/511 |
| 8,790,129 | B1 * | 7/2014 | Rengifo | H01R 13/639 439/468 |
| 2003/0049972 | A1 | 3/2003 | Aoki | |
| 2005/0239305 | A1 | 10/2005 | Akino | |
| 2010/0099280 | A1 | 4/2010 | Chen | |
| 2010/0184328 | A1 | 7/2010 | Kanatsu | |
| 2011/0256752 | A1 * | 10/2011 | Sakamoto | H01R 13/4362 439/370 |
| 2015/0099151 | A1 | 4/2015 | Lavender | |

* cited by examiner

EASILY REMOVABLE CONTACTS FOR MICRO CONNECTORS

RELATED APPLICATIONS

This application claims priority to U.S. Provisional Application No. 62/192,911, titled "EASILY REMOVABLE ELECTRICAL MICRO-CONNECTOR," filed on Jul. 15, 2015.

BACKGROUND OF THE INVENTION

The electronics in devices continue to become smaller in size. As a result, the components included in the electrical devices become smaller and smaller as well. This reduction in the size creates a number of challenges for designers as less and less space is provided for each component.

Electrical connectors are used to couple one electrical component to another electrical component. Electrical connectors are typically made of a plastic and metal materials and allow conductive elements to be removable attached to one another. A common use for such a connector is to connect two electrical devices together such that the two devices can be separated for maintenance or reversing the connections at a later time.

With the reduction in size of the electrical devices connected together, the removability of the connectors and the components making up the connectors has become increasingly difficult. A need exists for a micro sized electrical connector that includes easily removable contacts, abandoning standard practice of epoxy encapsulating the contacts in the connector body.

BRIEF SUMMARY OF THE INVENTION

The present disclosure is directed to a micro connector that includes a body having a plurality of openings with each opening sized to accommodate a conductive unit, such as a wire. Each opening includes an retention unit affixed to the connector body that prevents the conductive unit from moving back into the opening. The retention unit is configured such that the application of pressure on the retention unit will release the retention unit from the conductive unit.

One embodiment of the present disclosure includes a plug including a base having a top surface, a plurality of openings in the top surface, a retraction unit having a first portion in the base and a second portion extending from the base to a position in front of a corresponding opening, and a conductive unit having a notch, wherein the conductive unit extends through one opening such that the retraction unit engages the notch to prevent the conductive unit from passing back through the opening.

In another embodiment, the retraction unit extends from a mounting portion.

In another embodiment, the mounting portion is sized such that each retraction unit corresponds to an opening in the base.

In another embodiment, a front surface of the retention unit engages the notch on a corresponding conductive unit.

Another embodiment includes a case that is configured to receive the plug.

In another embodiment, each retention unit includes a notch.

In another embodiment, each retention unit is bent about the notch such that the retention unit angel towards the center of the mounting portion.

In another embodiment, a mounting portion of the retraction unit engages an opening in the case.

In another embodiment, the conductive unit is made of a conductive material.

In another embodiment, wherein the retention unit bends about the notch if a upward force is applied.

Another embodiment discloses a retention unit including a base portion, an opening in the center of the base portion, and a plurality of protrusions extending from the periphery of the opening in the base unit.

In another embodiment, the opening is sized to accommodate a plug with the plug including a plurality of openings.

In another embodiment, each protrusion includes a notch.

In another embodiment, each protrusion is bent towards the center of the opening at the notch.

In another embodiment, each protrusion includes a front surface that is configured to engage a latching portion on a conductive unit.

In another embodiment, the base portion is configured to engage an opening in a case.

In another embodiment, each protrusion bends towards and away from the center of the opening at the notch.

In another embodiment, the base portion is configured such that each retention unit is position adjacent to a corresponding opening in the plug.

In another embodiment, a rear surface of the base portion engages the plug.

In another embodiment, each protrusion extends from a bottom surface of the opening.

DETAILED DESCRIPTION OF THE INVENTION

Figure 1:
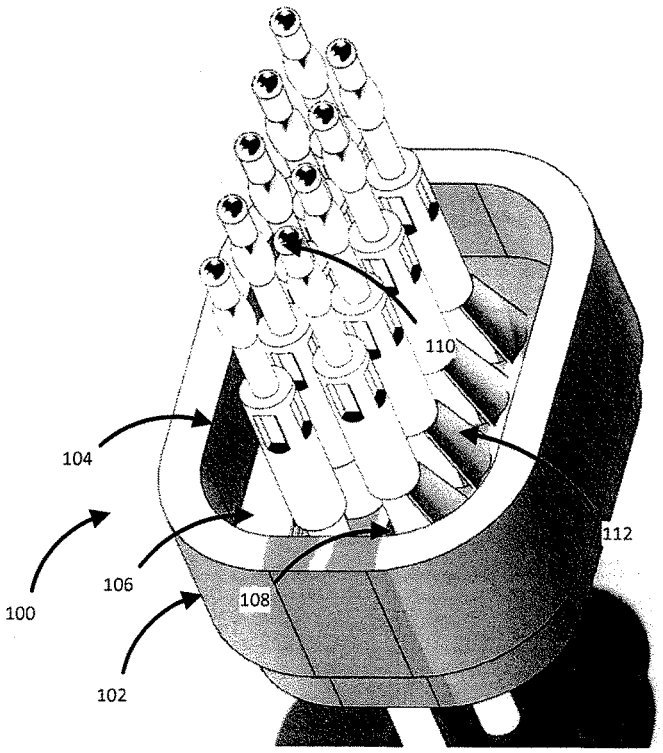
FIG. 1 depicts a plug 100 consistent with the present disclosure.

FIG. 1 depicts a plug 100 consistent with the present disclosure. The plug 100 includes a plug base 102 having an internal cavity 104 and a lower surface 106. A plurality of openings 108 are formed in the lower surface 106. The openings 108 are sized such that a conductive unit 110 can extend from one side of the lower surface 106 to the other side of the lower surface 106. The conductive unit 110 is made from an electrically conductive material such as, but not limited to, copper. In one embodiment, the conductive unit 110 is a wire. In another embodiment, the conductive unit 110 is a pin.

A retention unit 112 is positioned on the side of the lower surface 106 inside the cavity 104 and is flexibly affixed to the lower surface 106. The retention unit 112 is configured to engage a portion of the conductive unit 110 to prevent the conductive unit 110 from moving through the opening 108. The retention unit 112 may be made of any rigid material including hard plastic, metal or any other hard rigid material. Each conductive unit 110 may be removed from the respective opening 108 by pulling the retention unit 112 in a direction away from the conductive unit 110 such that the retention unit 112 is not in contact with the conductive unit 110. Because each opening 108 has a respective retention unit 112, the removal of one conductive unit 110 does not affect the position of the remaining conductive units 110 in the plug 100. In one embodiment, each retention unit 112 is biased such that the retention unit 112 applies a downward force on the conduction unit 110 when the retention unit 110 engages the latching portion 110

Figure 2:
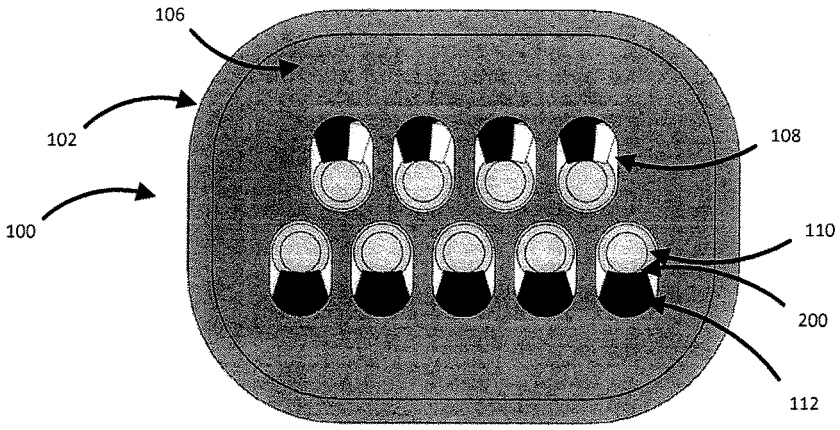
FIG. 2 depicts a top view of the plug.

FIG. 2 depicts a top view of the plug 100. The retention units 112 are positioned on the lower surface 104 such that the retention units 112 angle from the lower surface 104 towards the center of the opening 108. A portion of the retention unit 112 engages a surface of the conduction unit 110. When the conduction unit 110 is inserted into an opening 108, the conduction unit 112 pushes past the retention unit 112 pushing the retention unit 112 away from the lower surface 104. As the conduction unit 110 moves past the retention unit 112 a latching portion 200 formed on the surface of the conduction unit 110 engages the retention unit 112. The latching portion 200 may be an indention or channel formed on the surface of the conduction unit.

Figure 3:
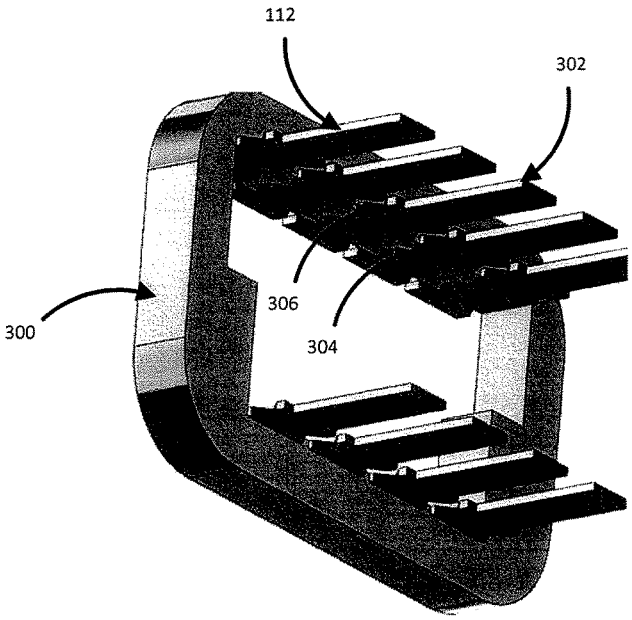
FIG. 3 depicts one embodiment of the retention units.

FIG. 3 depicts one embodiment of the retention units 112. Each retention unit 112 extends from a mounting structure 300. The mounting structure 300 has a size and shape that is configured to conform to the arrangement of the openings 108 in the lower surface 106 such that each retention unit 112 corresponds to an opening 108 in the lower surface 106 when the mounting structure 300 is inserted into the cavity 104 of the plug 100. Each retention unit 112 includes a front surface 302 that is configured to engage a latching portion 200 on the conduction unit 110 and a rear surface 304 including a notch 306 where the retention unit 112 is bent such that the front surface 302 is positioned in front of the respective opening 108.

Figure 4:
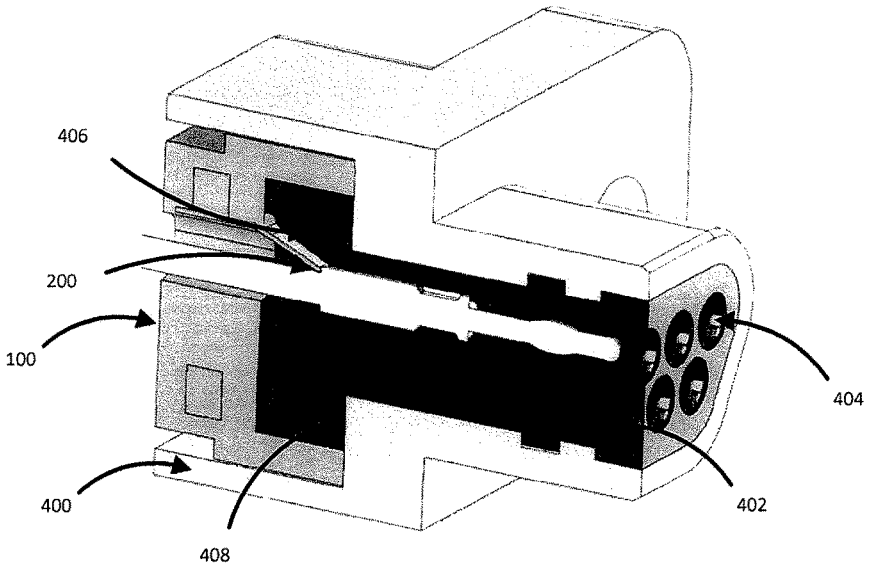
FIG. 4 depicts a cut away view of the plug.

FIG. 4 depicts a cut away view of the plug 100. The plug 100 is inserted into a case 400 with the conduction units 110 being inserted into corresponding openings 404 in a receiving plug 402. The rear surface 304 of the retention unit 112 is embedded in the plug 100 base with the front surface 302 being bent to engage a latching portion 200 on the conductive unit 110. By bending the front surface 302 down towards the conductive unit 110 such that the front surface 302 engages the latching portion 200 on the conductive unit 110, the conductive unit 110 is prevented from moving away from the receiving plug 402. The latching portion 200 may be a raised portion of the conductive unit 110 or may be a recess in the conductive unit 110.

The case 400 includes an opening 408 that is sized to accommodate the plug 100 with the exterior sidewalls of the plug base 102 engaging the interior surface of the cavity 408. The receiving plug 402 includes a plurality of openings 404 that each correspond to an opening 108 in the plug 100 when the plug 100 is inserted into the case 400. The conductive units 112 of the plug 100 are inserted into the openings 404 when the plug 100 is in the case 400.

In one embodiment, the receiving plug 402 includes a notch 406 in a lower portion 408 that is sized to configure a portion of the retention unit 112 when the retention unit 112 engages the conduction unit 110. A lower portion 408 of the receiving plug 402 extends into the cavity 102 of the plug 102 to affix the receiving plug 402 with the plug 100. An upper portion 410 of the receiving plug 402 is inserted into an upper portion of the case 400 with the end of the upper portion being open to allow access to the openings 408.

In the present disclosure, the words "a" or "an" are to be taken to include both the singular and the plural. Conversely, any reference to plural items shall, where appropriate, include the singular.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A plug including:

a base having a top surface;

a plurality of openings in the top surface;

a retraction unit having a first portion in the base and a second portion extending from the base to a position in front of a corresponding opening; and a conductive unit having a notch;

a case that is configured to receive the plug, wherein, the conductive unit extends through one opening such that the retraction unit engages the notch to prevent the conductive unit from passing back through the opening, and a mounting portion of the retraction unit engages an opening in the case.

2. The plug of claim 1, wherein the retraction unit extends from a mounting portion.

3. The plug of claim 2, wherein the mounting portion is sized such that each retraction unit corresponds to an opening in the base.

4. The plug of claim 1, wherein a front surface of the retraction unit engages the notch on a corresponding conductive unit.

5. The plug of claim 2, wherein each retraction unit includes a notch.

6. The plug of claim 5, wherein each retraction unit is bent about the notch such that the retention unit angel towards the center of the mounting portion.

7. The plug of claim 6, wherein the retraction unit bends about the notch if a upward force is applied.

8. The plug of claim 1, wherein the conductive unit is made of a conductive material.

* * * * *